United States Patent [19]

Masumoto et al.

[11] Patent Number: 4,684,416

[45] **Date of Patent: * Aug. 4, 1987**

[54] ALLOY WITH SMALL CHANGE OF ELECTRIC RESISTANCE OVER WIDE TEMPERATURE RANGE AND METHOD OF PRODUCING THE SAME

[75] Inventors: Hakaru Masumoto; Naoji Nakamura, both of Sendai, Japan

[73] Assignee: The Foundation: The Research Institute of Electric and Magnetic Alloys, Sendai, Japan

[ * ] Notice: The portion of the term of this patent subsequent to May 21, 2002 has been disclaimed.

[21] Appl. No.: 709,327

[22] Filed: Mar. 7, 1985

Related U.S. Application Data

[63] Continuation of Ser. No. 437,613, Oct. 29, 1982, Pat. No. 4,518,439.

[30] Foreign Application Priority Data

Dec. 14, 1981 [JP] Japan ..... 56-200065

[51] Int. Cl.[4] ..... C22F 1/14

[52] U.S. Cl. ..... 148/430; 148/3; 420/463

[58] Field of Search ..... 148/2, 3, 430, 11.5 R, 148/31.5; 420/463, 590

[56] References Cited

U.S. PATENT DOCUMENTS 4,374,679 2/1983 Matsumo et al. ..... 148/2
4,518,439 5/1985 Matsumo et al. ..... 148/3

OTHER PUBLICATIONS

Chemical Abstracts, vol. 86, article 164505v, 12/77.

*Primary Examiner*—L. Dewayne Rutledge
*Assistant Examiner*—S. Kastler
*Attorney, Agent,-or Firm*—Parkhurst & Oliff

[57] ABSTRACT

The disclosed alloy has a temperature coefficient of electric resistance with an absolute value smaller than 100 ppm/°C. in a temperature range between the order-disorder transformation point and melting point thereof, which alloy is made by molding an alloy consisting of 59.0–88.0 wt. % of palladium and the remainder of iron with a small amount of impurities, quenching the molded alloy from a temperature between the above-mentioned order-disorder transformation point and melting point to room temperature, cold working the quenched alloy for shaping, and annealing the shaped alloy.

5 Claims, 4 Drawing Figures

ALLOY WITH SMALL CHANGE OF ELECTRIC RESISTANCE OVER WIDE TEMPERATURE RANGE AND METHOD OF PRODUCING THE SAME

This is a continuation of application Ser. No. 437, 613, filed Oct. 29, 1982, now U.S. Pat. No. 4,518,439.

BACKGROUND OF THE INVENTION

1. Field of the Invention

This invention relates to an electric resistance alloy consisting essentially of palladium and iron with a small amount of impurities, which alloy is stable at very high temperatures. More particularly, the invention relates to an alloy material for electric resistive elements having a small change of electric resistance over a wide temperature range of 490°–1,340° C. and yet being easily workable at room temperature by forging, rolling, drawing, winding, shaping, and the like.

2. Description of the Prior Art

The need for measurement at high temperatures under very stringent conditions has been increasing these years in various industries, such as iron manufacturing industry, chemical industry, nuclear industry, space-related industry, and the like.

For instance, in the continuous casting process, the top surface of molten metal in a tundish or mold must be continuously controlled at a desired level, so as to ensure continuous production of iron or steel goods of high quality with a high yield through an uninterrupted casting process. Conventional level meters for molten metal which use γ-ray, x-ray, or other radioactive ray, have a shortcoming in that they are bulky and have safety problem. To overcome this shortcoming, the use of an eddy-current type displacement meter (to be referred to as "the displacement meter" hereinafter) of small size has been contemplated recently.

The performance of the displacement meter depends on the material of sensor coils assembled therein, so that the properties of the sensor coil material, such as electric characteristics, response to ambient conditions during use, and stability, are very important. For example, in the case of the continuous casting, the temperature of the molten metal can be as high as 1,500° C., and the sensor coils which are located immediately above the molten metal are required not only to withstand high temperatures of about 1,000° C. but also to maintain their utmost performance with a high stability over a long period of time as essential quality thereof.

The inventors disclosed a palladium-silver alloy (to be referred to as "the Pd-Ag alloy" hereinafter) consisting essentially of 55.5 to 60.6 wt. % of palladium and 44.5 to 39.4 wt. % of silver for the sensor coils of the displacement meter for use at high temperatures (see Japanese Patent Laying-open Publication No. 122,839/80). The Pd-Ag alloy has excellent corrosion-resistances and acid-resistances and good workability at high temperatures, and furthermore, the alloy is characterized by its very small temperature coefficient of electric resistance of less than +20 ppm/° C. over a wide temperature range of −50° C. to +600° C. (as shown by a curve for the reference alloy in FIG. 1). However, at the very high temperatures of 600°–1,000° C., the Pd-Ag alloy shows a large temperature coefficient of electric resistance of +133 ppm/° C., so that the sensor coils made of the Pd-Ag alloy are susceptible to large drifts at the very high temperatures such as those experienced in the above-mentioned continuous molding, and the accuracy of the displacement meter using such sensor coils is rapidly reduced at such very high temperatures and accurate measurement of level cannot be ensured. Accordingly, there has been a pressing need in various industries for novel material of sensor coils which ensures high accuracy of measurement in a very stable fashion at the very high temperatures in excess of 600° C.

SUMMARY OF THE INVENTION

Therefore, an object of the present invention is to meet such pressing need and to obviate the above-mentioned shortcoming of the prior art. After elaborate studies, the inventors have found that a binary alloy consisting essentially of 59.0–88.0 wt. % of palladium and 41.0–12.0 wt. % of iron with a small amount of impurities has not only a very small change of electric resistance over a wide temperature range between its order-disorder transformation point (490° C.) and its melting point (1,340° C.), but also excellent workability, so that the binary alloy has excellent stability of electric resistance at very high temperatures and serves as a good electric resistance alloy for sensor coils to be used at the very high temperatures.

Another object of the present invention is to provide an electric resistance alloy consisting essentially of 59.0–88.0 wt. % of palladium and 41.0–12.0 wt. % of iron with a small amount of impurities, which alloy has a temperature coefficient of electric resistance between −100 ppm/° C. and +100 ppm/° C. over a wide temperature range of 490°–1,340° C.

Another object of the present invention is to provide an electric resistance alloy consisting essentially of 72.0–86.5 wt. % of palladium and 28.0–13.5 wt. % of iron with a small amount of impurities, which alloy has a temperature coefficient of electric resistance between −50 ppm/° C. and +50 ppm/° C. over a wide temperature range of 570°–1,335° C.

The electric resistance alloys of the invention are suitable for sensor coils to be used at the very high temperatures.

A further object of the present invention is to provide a method of producing an electric resistance alloy comprising steps of molding an alloy consisting of 59.0–88.0 wt. % of palladium and the remainder of iron with a small amount of impurities, and quenching the molded alloy from a temperature higher than an order-disorder transformation point thereof but lower than a melting point thereof to room temperature, the alloy thus quenched is easy to forge, roll, draw, wind, and shape, so as to provide a sensor coil to be used at the very high temperatures.

A still other object of the invention is to provide a method of producing an electric resistance alloy by thoroughly annealing the above-mentioned quenched alloy at a temperature higher than the order-disorder transformation point thereof but lower than the melting point thereof, so as to render excellent stability of electric characteristics to the alloy.

The use of the electric resistance alloy of the invention is not restricted to the sensor coils for very high temperatures, but the alloy is suitable for various sensors and electric resistive elements of precision type measuring instruments which are exposed to very high temperatures in excess of 490° C. so as to effectively utilize the characteristics of the alloy. Besides, the alloy of the invention can be used in composite devices having such sensors or elements as constitutent parts thereof.

BRIEF DESCRIPTION OF THE DRAWINGS

For a better understanding of the invention, reference is made to the accompanying drawings, in which:

In FIG. 1, Tc shows a magnetic transformation point, $T_{o\text{-}d}$ shows a order-disorder transformation point.

DESCRIPTION OF THE PREFERRED EMBODIMENTS

A method of producing an electric resistance alloy according to the present invention will be described in detail now.

To produce the alloy of the invention, a suitable amount of starting material mixture consisting of 59.0-88.0 wt. % of palldaium and 41.0-12.0 wt. % of iron is melted at first in a non-oxidizing atmosphere or in vacuo by using a suitable melting furnace, and homogeneous molten alloy with a uniform composition is prepared by thoroughly agitating the thus molten alloy. A sound ingot is formed by pouring the molten alloy into an iron mold of suitable shape and size, and the ingot is worked at room temperature by forging or the like so as to prepare a suitably shaped alloy such as a bar or a plate. The shaped alloy is processed by cold working, such as swaging, drawing, rolling, or flattening, so as to form goods of desired shape such as a fine wire of a thin sheet. If the cold-worked goods such as the fine wire or thin sheet is going to be used as an electric resistive element, such cold-worked goods must be stabilized by thorough annealing, which annealing is effected by heating in vacuo or in a non-oxidizing atmosphere at a temperature higher than its order-disorder transformation point but lower than its melting point, preferably higher than a measuring temperature or a temperature at which the coldworked goods is to be used, e.g., at 1,050° C. or higher for a goods whose highest possible temperature of use is 1,000° C., keeping it at the heating temperature for 2 seconds to 100 hours, more preferably 5 minutes to 50 hours, and cooling it at a rate of 5°-300° C./hour, thereby producing a product in an ordered state. The method descirbed above provides excellent products.

Figure 2:
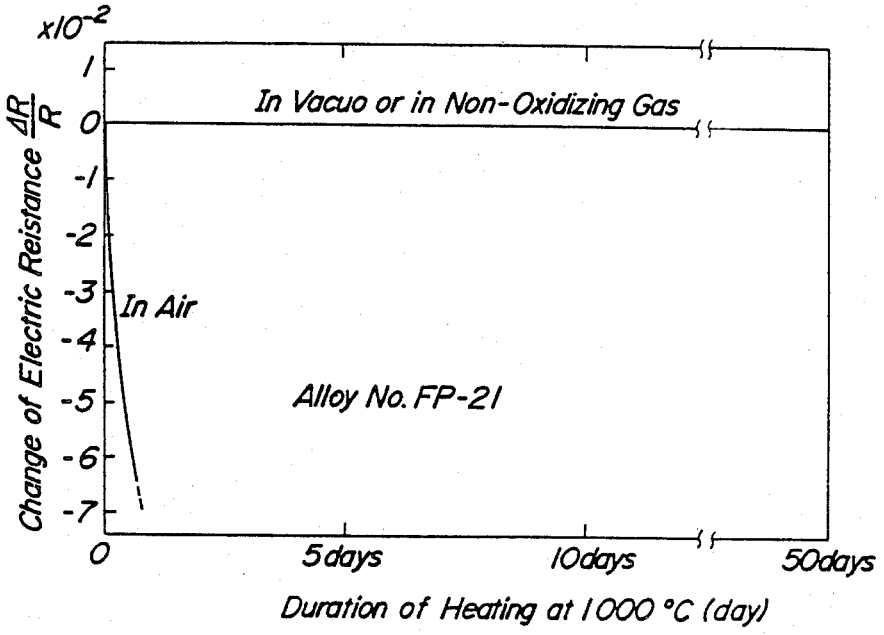
FIG. 2 is a graph showing the relationship between the electric resistances and duration of artificial aging by heating an alloy No. FP-21 (palladium 12.9% iron) at a constant temperature of 1,000° C. for up to 50 days in air, as compared with the corresponding relationship in the case of heating in vacuo or non-oxidizing gas.

One of the very important factors in the process of effecting the above-mentioned method or producing the electric resistance alloy of the invention is that the alloy has such a strong affinity with air or oxygen that exposure of the molten alloy to air causes not only considerable deterioration of the electric resistance as shown in FIG. 2 but also adverse effects to cold-working of the manufacturing process. Therefore, careful treatment of the molten alloy is necessary. More particularly, in the melting operation, the contact of the alloy with air or oxygen must be avoided by all means, and in addition, due care must be paid to the above-mentioned factor during various heat treatments in the manufacturing process after the melting and during the use of the alloy as a sensing device.

Apart from the above-mentioned oxidation, the alloy of the invention is susceptible to transformation into hard and brittle alloy of the ordered state ($\gamma_1$ phase and $\gamma_2$ phase) such as intermetallic compounds depending on the manner of the heat treatments, and such transformation tends to deteriorate the workability of the alloy. To further improve the workability, the disordered state ($\gamma$-phase) of the alloy can be ensured by quenching it during the working from a temperature higher than its order-disorder transformation point but lower than its melting point through suitable means, such as high-speed blowing of a non-oxidizing gas to it, quick cooling of it in an oil, and vacuum sealing of it in a quartz tube followed by dipping of it in ice water containing salt, so as to render good workability at room temperature. The fine wires or thin sheets of the alloy of the invention which are quenched in the above manner before the working are very soft and can be easily wound in the form of coils and spirals.

The above-mentioned treatment for rendering the good workability is an embodiment of the method of the invention.

The following three methods of insulating the alloy of the invention are possible.

(A) Wires, sheets, or other suitably shaped goods of the alloy of the invention prepared by such working as casting, forging, rolling, or drawing are fastened to one or more insulating material members; for instance, by embedding them in a heat-resisting insulating material such as high-purity ceramic paste, by directly adhering them to heat-resisting insulating member with alumina adhesive, by winding them on a cylindrical ceramic member, or by sandwiching them between two insulating plates.

(B) To improve the space factor of the sensor coils in instruments, heat-resisting inorganic insulating films are adhered to the surfaces of the suitably shaped goods of the alloy of the invention formed by casting, forging, rolling, or drawing, and the shaped goods with the insulating films are worked so as to produce products of desired form such as windings or the like. Examples of the heat-resisting inorganic insulating films are silica, alumina, magnesia, fluorides, borides, and nitrides, and examples of the method of adhering the insulating films to the surfaces of the shaped goods are electrodeposition, vacuum evaporation, plating, and sputtering.

(C) Heat-resisting inorganic insulating films are adhered to the surfaces of the suitably shaped goods of the alloy of the invention, and then the shaped goods with the insulating films are worked so as to produce products of desired form by etching, punching, or trimming. Examples of the method of the above-mentioned adhering of the insulating films to the surfaces of the shaped goods are electrodeposition, vacuum evaporation, plating, and sputtering.

Although the products finished by the above-mentioned insulating method are ready for practical application, if necessary the annealing may be applied to the insulated products in the above-mentioned manner, so as to stabilize the alloy material thereof. Whereby, the characteristics of the electric resistance alloy can be fully utilized to provide excellent sensors or resistive elements to be used at the very high temperatures.

The invention will be described in further detail by referring to examples.

EXAMPLE 1

(Preparation of alloy No. FP-18 (86.5% of Pd and 13.5% of Fe)

Figure 1:
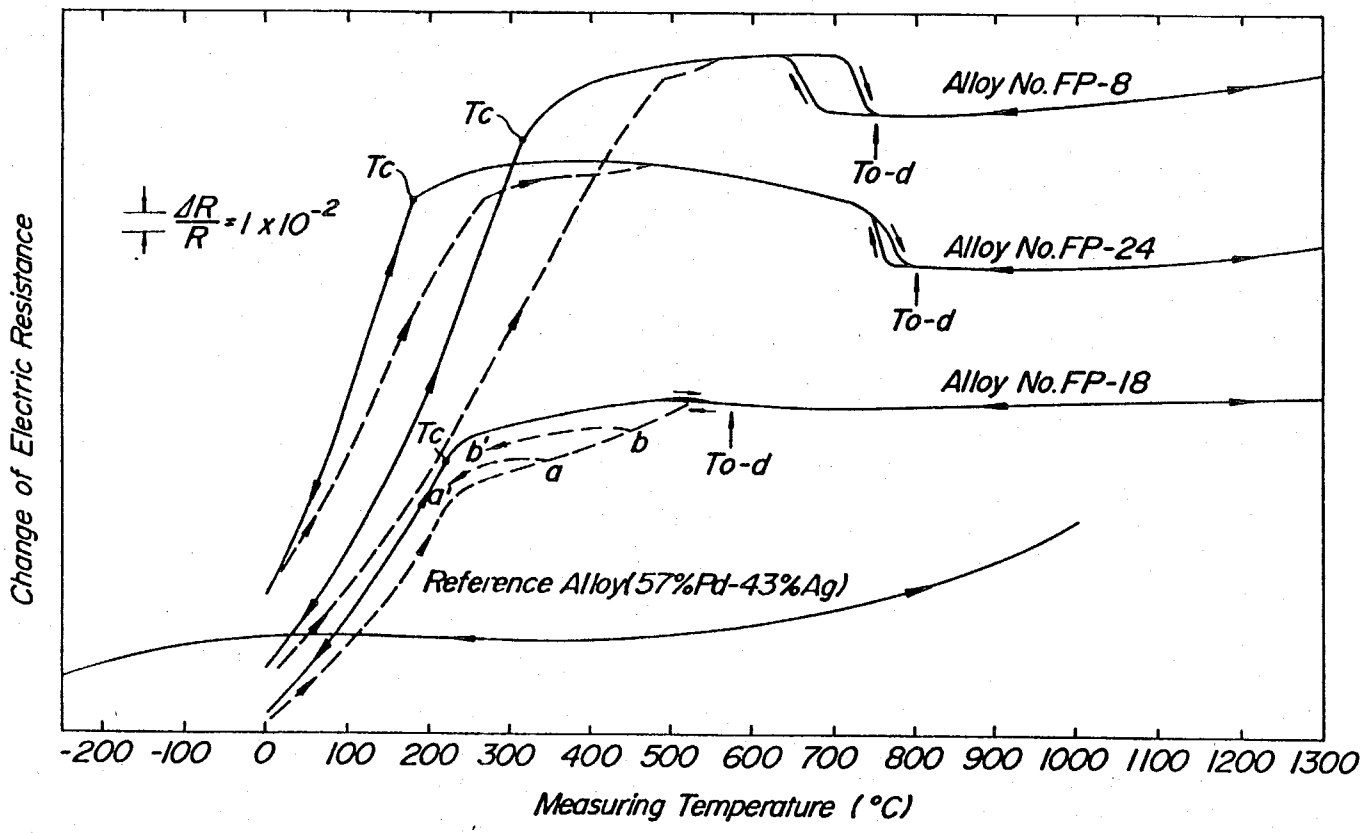
FIG. 1 is a graph for alloys of the invention as numbered FP-18, FP-24, and FP-8 and a reference alloy consisting of 57% of palladium and 43% of silver, under the conditions of both as worked and as annealed after being worked.

As starting materials, palladium with a purity of higher than 99.9% and iron with a purity of higher than 99.9% were used. Specimens were prepared by placing 100 g in total of the starting materials in a high-purity alumina crucible, melting them in a high-frequency induction furnace while blowing high-purity argon gas to the surface of the contents of the crucible to prevent oxidation of the starting materials, thoroughly agitating the molten materials so as to produce homogeneous molten alloy, and molding by pouring the molten alloy in an iron mold with an inner diameter of 7 mm and a height of 180 mm. Surface unevenness of the ingot thus molded was removed, and the ingot was cold worked by swagging so as to reduce the ingot diameter to 5 mm. The swaged ingot was homogenized by heating at 1,150° C. in vacuo and then water quenched from 1,000° C. which is above the order-disorder transformation point (570° C.) thereof. Fine wires with a diameter of 0.5 mm were prepared by repeating the swaging and cold drawing while applying several water quenching in between. Lengths of about 10 cm were cut off from the fine wires for use as the desired specimens for the measurement of the electric resistivity thereof in vacuo at a temperature between the room temperature and 1,300° C. The result is shown in the curve FP-18 of FIG. 1. In FIG. 1, $T_c$ shows a magnetic transformation point and $T_{o-d}$ shows an order-disorder transformation point. The alloy show non-magnetic property in the temperature more than said magnetic transformation point $T_c$, and is ferromagnetic in the temperature of less than said $T_c$. In FIG. 1, dashed lines represent the electric resistance of the specimens as worked while the solid lines represent that of the specimens after the annealing. Since the structure of the alloy as worked was not stable, if the alloy was cooled from an intermediate temperature during the heating, such as the point a (350° C.) or b (450° C.) which are temperatures lower than the order-disorder transformation point $T_{o-d}$, the locus of the reduction of the electric resistances differed from that of the increase thereof during the heating, as shown by the loci a—a' and b—b' of FIG. 1. Thus, without the annealing, the variation of the electric resistance of the specimen showed hysteresis. On the other hand, the specimen which was annealed at a temperature above the order-disorder transformation point $T_{o-d}$ (=570° C.) showed substantially the same locus of the electric resistance variation even after repeated heatings and coolings, except a small hysteresis loop in the vicinity of the order-disorder transformation point $T_{o-d}$, as shown by the solid line of FIG. 1. It was found that the variation of the electric resistance at temperatures above the point $T_{o-d}$ was very small as compared with that at temperatures below the point $T_{o-d}$. Table 1 and FIG. 1 show the variation of the electric resistance characteristics of the specimens for different heat treatments.

Average temperature coefficients of electric resistance in the temperature ranges 800°-900° C., 900°-1,000° C., and 800°-1,000° C. are shown in items 1, 2, and 3 of Table 1. When the differences among values in the items 1 through 3 are small, the second order derivative of the electric resistance variation is small and the electric resistance varies linearly. It was confirmed that even if the specimens were heated to 1,300° C. and then cooled to keep them at 1,000° C. for 50 days and at 1,100° C. for 20 days, the electric resistance of the specimens did not show any change.

TABLE 1

| | Properties of Alloy No. FP-18 | | | |
|---|---|---|---|---|
| | Item | | | |
| Heat treatment | 1 Temperature coefficient of electric resistance at 800-900° C. (ppm/°C.) | 2 Temperature coefficient of electric resistance at 900-1,000° C. (ppm/°C.) | 3 Temperature coefficient of electric resistance at 800-1,000° C. (ppm/°C.) | 4 Specific resistivity at 900° C. (μΩ-cm) |
| After cold drawing, heating at 900° C. for 5 hours in vacuo and cooling in furnace to room temperature at 150° C./hour | +26 | +45 | +35 | 100 |
| After cold drawing, heating at 1,000° C. for 30 minutes in vacuo and cooling in furnace to room temperature at 150° C./hour | +25 | +43 | +33 | 100 |
| After cold drawing, heating at 1,250° C. for 5 minutes in vacuo and cooling in furnace to room temperature at 300° C./hour | +25 | +43 | +33 | 100 |

EXAMPLE 2

Production of Alloy No. FP-24 (80.2% OF PD AND 19.8% OF FE)

Palladium and iron with the same purities as those of Example 1 were used as the starting materials. Specimens were prepared by placing 10 g in total of the starting materials in a high-purity alumina crucible (SSA-H, No. 2), melting them in a Tammann furnace while blowing high-purity argon gas to the surface of the contents of the crucible to prevent oxidation of the starting materials, thoroughly agitating the molten materials so as to produce a homogeneous molten alloy, sucking the molten alloy into a quartz tube with an inner diameter of 2.6–2.7 mm, pouring the molten alloy into another quartz tube having one end closed and an inner diameter which is somewhat larger than a desired specimen diameter, and homogenizing the alloy by heating it in the quartz tube at 1,000° C. for 10 minutes and water quenching. Fine wires with a diameter of 0.5 mm were prepared by swaging and cold drawing of the thus quenched alloy. Lengths of about 10 cm were cut off from the fine wires for use as the desired specimens. The characteristics of the specimens thus prepared for different heat treatments are shown in Table 2 and FIG. 1, which characteristics showed similar tendencies to those of Example 1.

TABLE 2

| Heat treatment | Properties of Alloy No. FP-24 Item 1 Temperature coefficient of electric resistance at 800–900° C. (ppm/°C.) | 2 Temperature coefficient of electric resistance at 900–1,000° C. (ppm/°C.) | 3 Temperature coefficient of electric resistance at 800–1,000° C. (ppm/°C.) | 4 Specific resistivity at 900° C. (μΩ-cm) |
|---|---|---|---|---|
| After cold drawing, heating at 900° C. for 5 hours in vacuo and cooling in furnace to room temperature at 50° C./hour | −105 | +30 | −35 | 120 |
| After cold drawing, heating at 1,000° C. for 30 minutes in vacuo and cooling in furnace to room temperature at 50° C./hour | −100 | +27 | −38 | 120 |
| After cold drawing, heating at 1,200° C. for 5 minutes in vacuo and cooling in furnace to room temperature at 150° C./hour | −100 | +27 | −38 | 120 |

EXAMPLE 3

Production of alloy No. FP-8 (70.0% of Pd and 30.0% of Fe)

The starting materials and the preparation of specimens were the same as those of Example 2. The characteristics of the specimens of Example 3 for different heat treatments are shown in Table 3 and in the curve FP-8 of FIG. 1, which characteristics showed similar tendencies as those of Examples 1 and 2.

TABLE 3

| Heat treatment | Properties of Alloy No. FP-8 Item 1 Temperature coefficient of electric resistance at 800–900° C. (ppm/°C.) | 2 Temperature coefficient of electric resistance at 900–1,000° C. (ppm/°C.) | 3 Temperature coefficient of electric resistance at 800–1,000° C. (ppm/°C.) | 4 Specific resistivity at 900° C. (μΩ-cm) |
|---|---|---|---|---|
| Ater cold drawing, heating at 900° C. for 5 hours in vacuo and cooling in furnace to room temperature at 15° C./hour | +65 | +87 | +76 | 129 |
| After cold drawing, heating at 1,000° C. for 30 minutes in vacuo and cooling in furnace to room temperature at 15° C./hour | +63 | +86 | +75 | 129 |
| After cold drawing, heating at 1,200° C. for 5 minutes in vacuo and cooling in furnace to room temperature at 120° C./hour | +63 | +86 | +75 | 129 |

Figure 3:
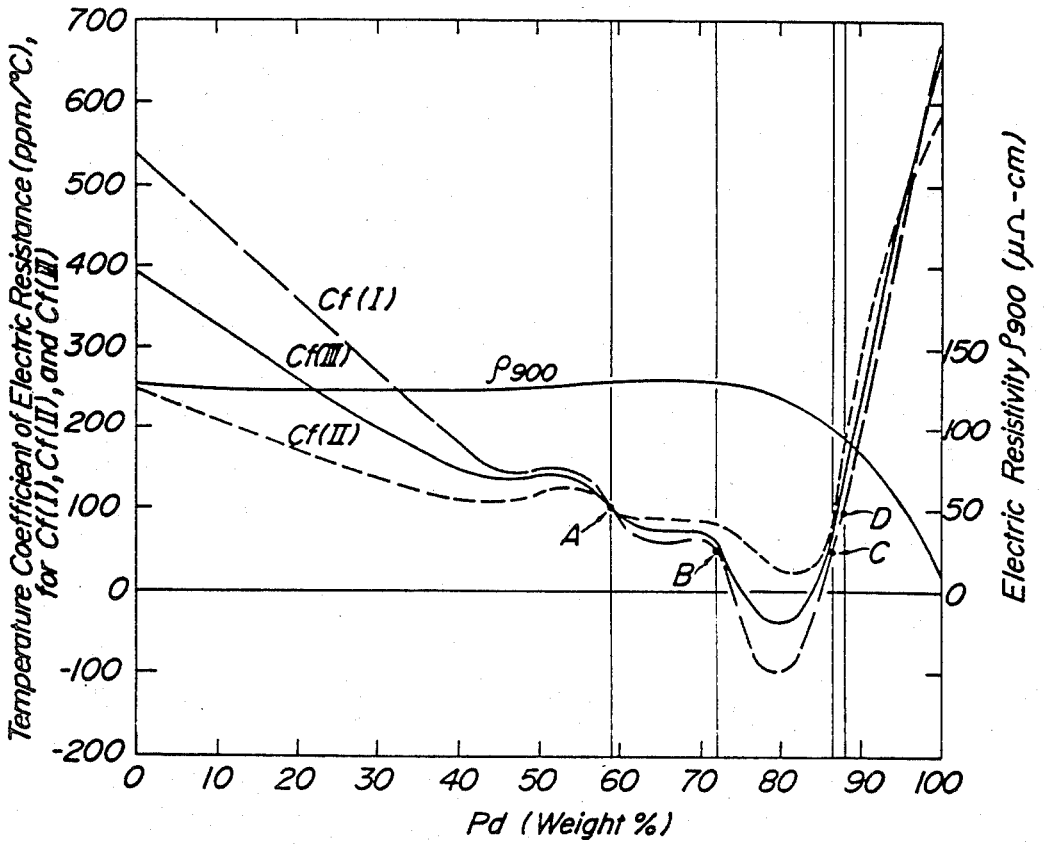
FIG. 3 is a graph showing the relationship between the average temperature coefficient of electric resistance and palladium concentration and between electric resistivity at 900° C. ($p_{900}$) and palladium concentration, for different chemical compositions of the palladium-iron alloy, wherein three average coefficients $C_f$(I), $C_f$ (II), and $C_f$ (III) for three temperature ranges I (800°-900° C.), II (900°-1,000° C.), and III (800°-1,000° C.) are indicated.

Referring to FIG. 3, experiments similar to those of Examples 1 through 3 were carried out for full range of palladium-iron binary alloy composition, and the average temperature coefficient of electric resistance ($C_f=(\Delta R/R\cdot\Delta T)$) and the electric resistivity at 900° C. ($\rho_{900}$) for different palladium concentrations were determined as shown in the figures. The average temperature coefficients $C_f$ were measured in three different temperature ranges, namely the temperature range I (800°–900° C.), temperature range II (900°–1,000° C.), and temperature range III (800°–1,000° C.). The graph of the figure indicates that the desired small temperature coefficient of electric resistance $C_f$ between −100 ppm/° C. and +100 ppm/° C. can be obtained only when the palladium concentration is 59.0–88.0 wt. % (between the points A and D of FIG. 3), and the preferred smaller temperature coefficient of electric resistivity $C_f$ between −50 ppm/° C. and +50 ppm/° C. can be obtained only when the palladium concentration is 72.0–86.5 wt. % (between the points B and C of FIG. 3). As the differences among the temperature coefficients $C_f$(I), $C_f$(II), and $C_f$(III) for the temperature ranges I, II, and III increase, the second order derivative of the electric resistance variation becomes larger. On the contrary, as the differences among the temperature coefficients $C_f$(I), $C_f$(II), and $C_f$(III) decrease, the second order derivative of the electric resistance variation becomes smaller. For instance, at the point A of FIG. 3, the three curves for the temperature coefficients $C_f$(I), $C_f$(II), $C_f$(III) intersect, so that the second derivative of the electric resistance variation is zero at this point, and the electric resistance varies linearly in the temperature range of 800°-1,000° C.

The electric resistivity $\rho_{900}$ of the alloy of the invention assumes a maximum value of 130 $\mu\Omega$-cm and varies to 92 $\mu\Omega$-cm at the palladium concentration of 88.0%. Such resistivity is about three times that of the reference alloy of FIG. 2 at the room temperature which is 39 $\mu\Omega$-cm (as disclosed in Japanese Patent Laying-open Publication No. 122,839/80). Although the high electric resistivity is a negative factor which tends to reduce the sensitivity of a very-high-temperature displacement meter, the resistivity does not cause any practical difficulty because high-frequency currents of several kHz to several MHz flow along the surface of the alloy wire of the sensor coil and the surface area of the sensor coil wire can be easily increased by using the alloy wire having a larger diameter.

Figure 4:
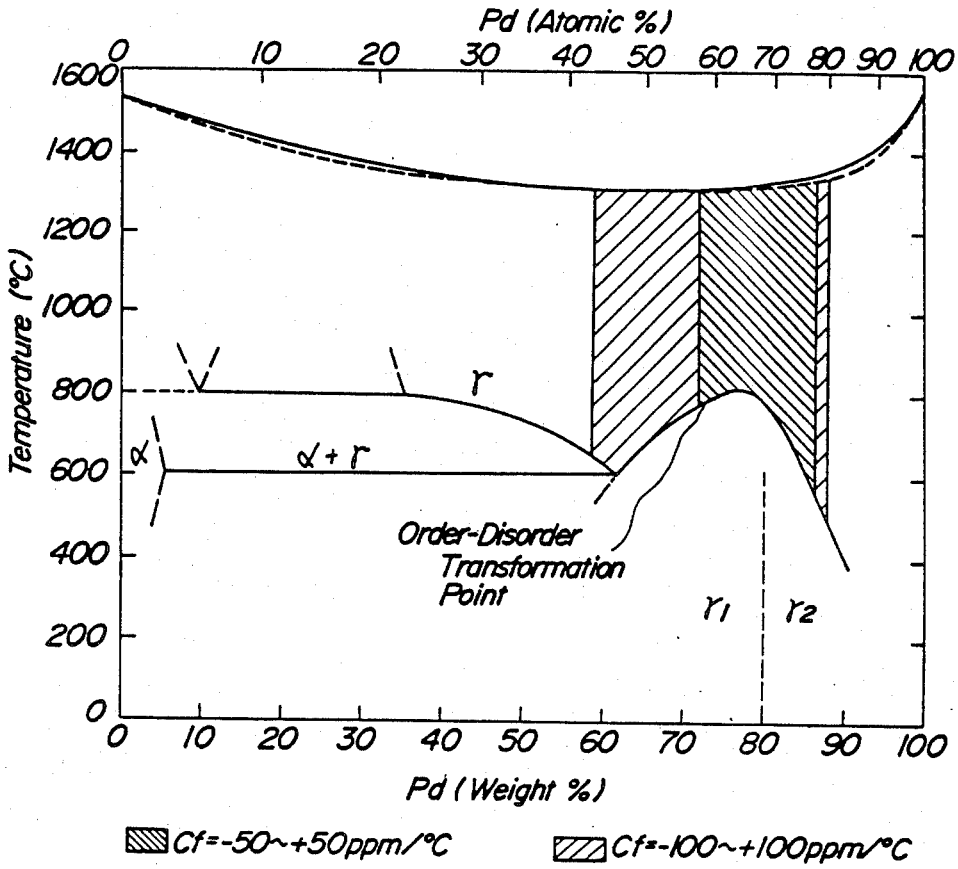
FIG. 4 is an equilibrium diagram showing two temperature-composition ranges wherein the temperature coefficient of electric resistance $C_f$ is between −100 ppm/° C. and +100 ppm/° C. and between −50 ppm/° C. and +50 ppm/° C., for alloys of the invention consisting essentially of 59.0-88.0 wt. % of palladium and 41.0-12.0 wt. % of iron.

In an iron-palladium system equilibrium diagram of FIG. 4, wide and narrow shaded portions indicate that the alloy of the invention consisting of 59.0–88.0 wt. % of palladium and 41.0–12.0 wt. % of iron has a temperature coefficient of electric resistance $C_f$ between −100 ppm/° C. and +100 ppm/° C. and between −50 ppm/° C. and +50 ppm/° C. The above mentioned temperature coefficients are valid over a wide temperature range betwen the order-disorder transformation point and the melting point of the alloy, and more particularly the temperature coefficient $C_f$ with an absolute value of not greater than 100 ppm/° C. is valid in a temperature range of 490°-1,340° C. while the temperature coefficient $C_f$ with an absolute value of not greater than 50 ppm/° C. is valid in a temperature range of 570°-1,335° C. Referring to FIG. 1; the curve for the alloy No. FP-24 has a portion in the neighborhood of about 400° C. where the change of electric resistance is small, but said portion involves a discontinuous change at the order-disorder transformation point and does not satisfy the condition of small change of electric resistance over a wide temperature range as aimed at by the invention, so that said portion is not indicated in FIG. 4.

As described in the foregoing by referring to Examples 1 through 3, the alloy of the invention has a small change of electric resistance for different temperatures. Especially, the alloy No. FP-18 of Example 1 has a comparatively large electric resistivity $\rho_{900}$ of 100 $\mu\Omega$-cm, but its electric resistance varies only very little over a wide temperature range of 570°-1,335° C., and such small change of electric resistance of this alloy of the invention is fully reproducible, so that this alloy of the invention can provide a high stability in final products. None of individual materials of the prior art provides such low temperature coefficient of electric resistance between −50 ppm/° C. and +50 ppm/° C. over the wide temperature range of 570°-1,335° C., so that the alloy of the present invention fully meets the characteristics which are required for the alloys of very-high-temperature sensor coils.

The reasons for limiting the palladium concentration to 59.0–88.0 wt. % in the alloy of the invention is in that the palladium concentration outside of this limitation is not suitable for providing the alloy having a small change of electric resistance over a wide temperature range, because the alloy composition outside of the above-mentioned limitation has a larger temperature coefficient of electric resistance than between −100 ppm/° C. and +100 ppm/° C. over a temperature range of 490°-1,340° C., as can be seen from the above Examples 1 through 3 and the curves of FIG. 1, FIG. 3, and FIG. 4.

The reason for using the quenching from a temperature higher than the order-disorder transformation point (490° C.) but lower than the melting point (1,340° C.) before the annealing in the method of producing the alloy of the invention is that the quenching from the temperature in the above-mentioned range results in $\gamma$-single-phase (disordered state) which renders excellent workability at room temperature as can be seen from Examples 1 through 3 and the curves of FIG. 1, FIG. 2, and FIG. 4. On the other hand, quenching from a temperature below the order-disorder transformation point is not suitable for producing the alloy of the invention because such quenching makes alloys so brittle and hard that the thus produced alloys are hard to work at room temperature and difficult to form the desired coils or the like. It should be noted that if the sequence of the quenching and the annealing is reversed in the method of the invention, the annealing tends to render the alloy so brittle and hard that the alloy becomes hard to form the desired coils, so that such reversing of the sequence is not suitable for producing the alloy of the invention.

In short, the alloy of the present invention is characterized in that the alloy has a very small change of electric resistance, i.e., a temperature coefficient with an absolute value of less than 100 ppm/° C. over a wide temperature range higher than the order-disorder transformation point thereof (490° C.) but lower than the melting point thereof (1,340° C.), that the alloy is very stable over a long period of time at a very high temperature such as 1,100° C., and that the workability of the alloy can be further improved by quenching from a temperature higher than the order-disorder transformation point thereof (490° C.) but lower than the melting point thereof (1,340° C.), preferably in a range of 570°-1,335° C. Thus, the alloy of the invention is suitable for electric resistive elements of precision type measuring instruments, such as very-high-temperature sensor coils and standard resistance elements to be used over a wide temperature range of 490°-1,340° C. The excellent characteristics of the alloy of the invention can be fully utilized in sensor coils and electric resistive elements which are combined with other functional elements in forming various industrial devices such as composite sensors like position sensors, three-dimensional sensors, displacement sensors, pressure sensors, weight sensors, acceleration sensors, vibration sensors, torque sensors, level sensors, or composite switches like float switches, limit switches, proximity switches, and the like.

What is claimed is:

1. An electric resistance alloy consisting essentially of 59.0–88.0 wt % of palladium and the remainder of iron, said alloy having a temperature coefficient of electric resistance with an absolute value smaller than 100 ppm/° C. over a temperature range of 490° C. to 1340° C. and being in an ordered state at room temperature, prepared by:

melting in a non-oxidizing atmosphere an alloy consisting essentially of 59.0–88.0 wt % of palladium and the remainder of iron; molding the melt of said alloy in a mold; quenching the molded alloy from a temperature higher than the order-disorder transformation point thereof but lower than the melting point thereof to room temperature; cold working the quenched alloy into a desired form; and annealing the shaped alloy by heating in a non-oxidizing atmosphere at a temperature higher than the order-disorder transformation point thereof but lower than the melting point thereof for a duration longer than 2 seconds but shorter than 100 hours and cooling at a rate of 5°–300° C./hour.

2. An electric resistance alloy as defined in claim 1, wherein the alloy consists essentially of 72.0–86.5 wt % of palladium and the remainder of iron, said alloy having a temperature coefficient of electric resistance with an absolute value smaller than 50 ppm/° C. over a temperature range of 570° C. to 1335° C.

3. An electric resistance alloy product consisting essentially of 59.0–88.0 wt % of palladium and the remainder of iron, said alloy product having a temperature coefficient of electric resistance with an absolute value smaller than 100 ppm/° C. over a temperature range of 490° C. to 1340° C. and being in an ordered state at room temperature, prepared by:

melting in a non-oxidizing atmosphere an alloy consisting essentially of 59.0–88.0 wt % of palladium and the remainder of iron; molding the melt of said alloy in a mold, quenching the molded alloy from a temperature higher than the order-disorder transformation point thereof but lower than the melting point thereof to room temperature; cold working the quenched alloy into a desired form; fastening the shaped alloy to a heat-resisting insulating member; and annealing the shaped alloy by heating in a non-oxidizing atmosphere at a temperature higher than the order-disorder transformation point thereof but lower than the melting point thereof for a duration longer than 2 seconds but shorter than 100 hours and cooling at a rate of 5°–300° C./hour.

4. An electric resistance alloy product consisting essentially of 59.0–88.0 wt % of palladium and the remainder of iron, said alloy product having a temperature coefficient of electric resistance with an absolute value smaller than 100 ppm/° C. over a temperature range of 490° C. to 1340° C. and being in an ordered state at room temperature, prepared by:

melting in a non-oxidizing atmosphere an alloy consisting essentially of 59.0–88.0 wt % of palladium and the remainder of iron; molding the melt of said alloy in a mold; quenching the molded alloy from a temperature higher than the order-disorder transformation point thereof but lower than the melting point thereof to room temperature; applying heat-resisting insulating material onto the surface of the quenched alloy; cold working the insulated alloy into a desired form; and annealing the shaped alloy by heating in a non-oxidizing atmosphere at a temperature higher than the order-disorder transformation point thereof but lower than the melting point thereof for a duration longer than 2 seconds but shorter than 100 hours and cooling at a rate of 5°–300° C./hour.

5. An electric resistance alloy product consisting essentially of 59.0–88.0 wt % of palladium and the remainder of iron, said alloy product having a temperature coefficient of electric resistance with an absolute value smaller than 100 ppm/° C. over a temperature range of 490° C. to 1340° C. and being in an ordered state at room temperature, prepared by:

melting in a non-oxidizing atmosphere an alloy consisting essentially of 59.0–88.0 wt % of palladium and the remainder of iron; molding the melt of said alloy in a mold; quenching the molded alloy from a temperature higher than the order-disorder transformation point thereof but lower than the melting point thereof to room temperature; cold working the quenched alloy into a worked member; applying heat-resisting insulating material onto the surface of the worked member; shaping the worked member into a desired form; and annealing the shaped alloy by heating in a non-oxidizing atmosphere at a temperature higher than the order-disorder transformation point thereof but lower than the melting point thereof for a duration longer than 2 seconds but shorter than 100 hours and cooling at a rate of 5°–300° C./hour.

* * * * *